United States Patent [19]

Goudreau

[11] Patent Number: 5,031,783

[45] Date of Patent: Jul. 16, 1991

[54] ADJUSTABLE WIRE DISPLAY RACK

[76] Inventor: Rodney A. Goudreau, Main St., West Warren, Mass. 01092

[21] Appl. No.: 289,562

[22] Filed: Dec. 23, 1988

[51] Int. Cl.[5] ..... A47F 5/00

[52] U.S. Cl. ..... 211/181; 211/59.1; 211/106; 211/207; 248/222.2

[58] Field of Search ..... 211/87, 88, 181, 193, 211/189, 106, 57.1, 59.1, 133, 207, 175; 248/222.2, 225.2, 225.1

[56] References Cited

U.S. PATENT DOCUMENTS 3,172,539 3/1965 Rulf ..... 211/59.1
3,995,744 12/1976 Metay ..... 211/181 X
4,289,246 9/1981 Scott ..... 211/181 X
4,501,369 2/1985 Fox ..... 211/133
4,586,618 5/1986 Norman ..... 211/133

FOREIGN PATENT DOCUMENTS 1478879 3/1967 France ..... 211/106

*Primary Examiner*—Robert W. Gibson, Jr.
*Attorney, Agent, or Firm*—Paul G. Lunn

[57] ABSTRACT

Disclosed is a wire rack display unit having vertical support means, horizontal wires attached to and movable along the length of the vertical wires and brackets. In a preferred embodiment the brackets are attached to the horizontal wires by means of positive lock mechanism.

11 Claims, 3 Drawing Sheets

ADJUSTABLE WIRE DISPLAY RACK

TECHNICAL FIELD

The present invention is in the field of advertising display racks.

BACKGROUND ART

Merchandise display racks are used to display merchandise on store shelves and in store windows. These display racks generally are comprised of brackets attached to a rear supporting structure. Merchandise can be attached to or on the brackets. The display racks holding the merchandise can then be placed in store windows or on counters where the merchandise can be viewed by the public. A major problem associated with display racks of the prior art is that they lack versatility in that they are constructed in a predetermined size so that they can not be used effectively in displaying varying types of merchandise in a wide variety of store spaces having varying width, length and height restrictions.

Due to this lack of versatility, marketing and display planners must spend a considerable amount of time and effort planning and designing how to arrange merchandise on the display racks of the prior art.

DISCLOSURE OF THE INVENTION

The present invention relates to a wire display rack which is adjustable both horizontally and vertically. The wire display rack is comprised of horizontal wires and means for attaching the horizontal wires to vertical support means so that the horizontal wires are movable up and down the length of the vertical support means such that the horizontal wires can be secured at any point along the length of the vertical support means and brackets extending from the horizontal wires. In a preferred embodiment the vertical support means are wires. In the present application a bracket refers to any supporting element which can be attached to and extend from horizontal wires or vertical wires of the display rack whether it is a hook, clamp, shelve or other supporting element.

The present invention is also related to a new type of bracket onto which merchandise can be placed. The bracket is comprised of a support means and extending from said support means is a means for securing the support means onto the horizontal wires. The means for securing the support means extends from the support means and over and under an upper horizontal wire and over and under a lower horizontal wire to form an inverted 'S' which locks the bracket in place such that neither a force on top of the bracket nor a force from beneath the bracket will dislodge the bracket. In a preferred embodiment the bracket can be readily moved laterally along the length of the horizontal wires.

In the present application the term wire is used so that it can be made not only of metal but also of any plastic or wood so long as the characteristic dimensions of standard wire are maintained. Also, the cross-section of the wire need not be circular but may be any shape.

The objects and features of the present invention will become apparent from the following detailed description of a preferred embodiment of the present invention considered in connection with the accompanying drawings which disclose several embodiments of the invention. It is to be understood that the drawings are used for the purpose of illustration only and not as a definition of the limits of the invention.

In the drawings, similar reference characters denote similar elements throughout the several views.

BEST MODE FOR CARRYING OUT THE INVENTION

Figure 1:
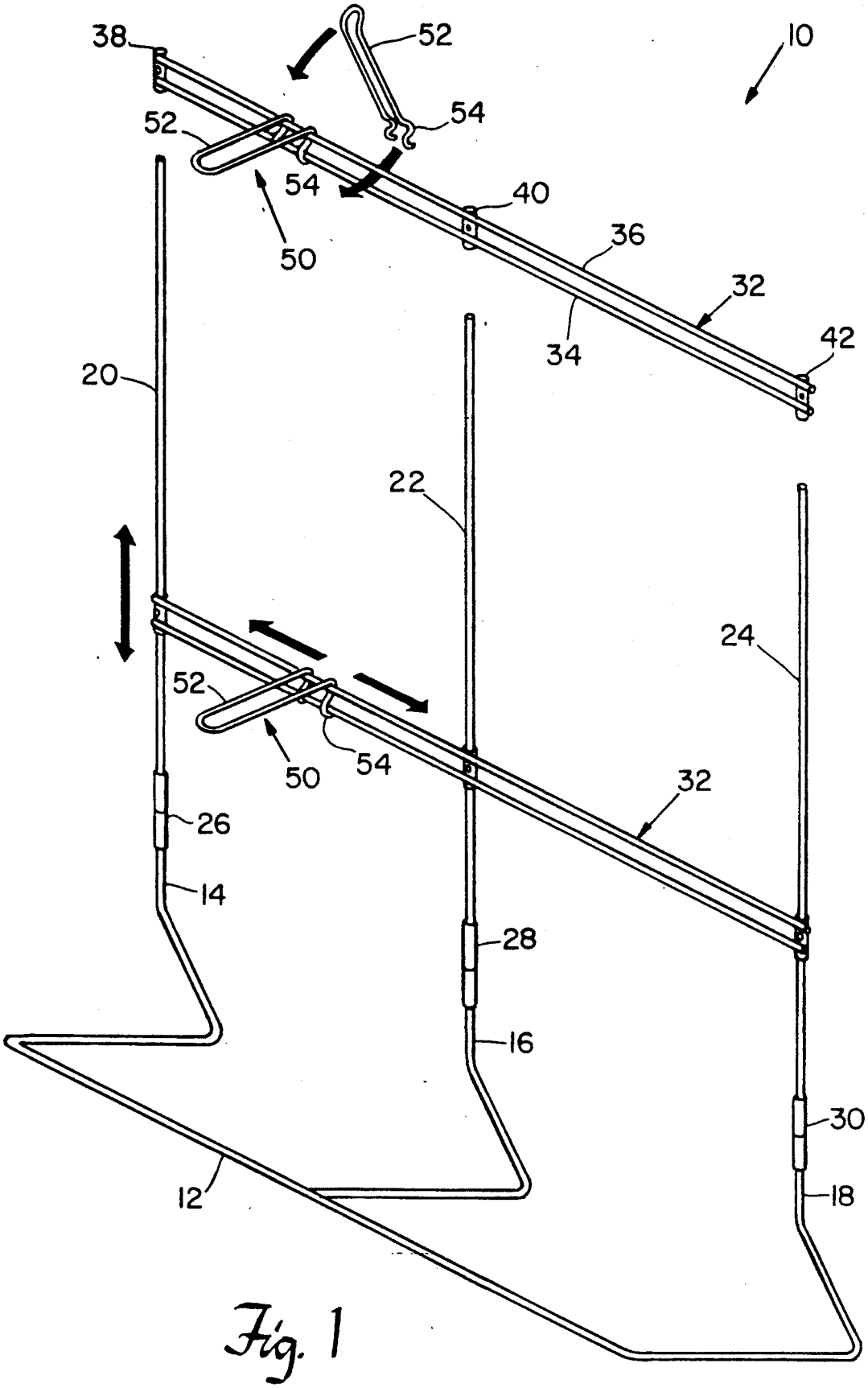
FIG. 1 depicts a frontal view in perspective of a preferred embodiment of the present invention.

FIG: 1 shows a wire display rack of the present invention designated 10. Wire display rack 10 has a base 12. Extending from base 12 are three vertical support wires 14, 16 and 18. Extending from and attached to vertical support wires 14, 16 and 18 are vertical support extension wires 20, 22 and 24 by means of tubes 26, 28 and 30 respectively.

Figure 2:
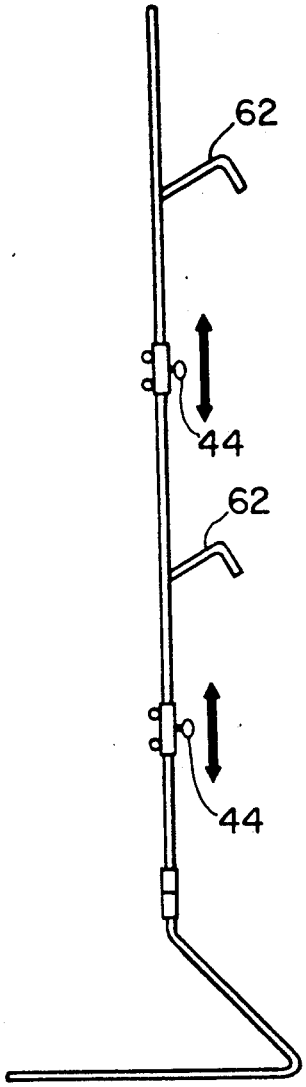
FIG. 2 depicts a side view of the embodiment of the present invention shown in FIG: 1.

Horizontal wire support units 32 are attached to the vertical wires and can be readily moved up and down the length of the vertical wires. The horizontal wire support units are comprised of horizontal wires 34 and 36 welded onto vertical support tubes 38, 40 and 42 and are so positioned along the length of horizontal wires 34 and 36 such that the vertical wires 20, 22 and 24 can simultaneously slide through tubes 38, 40 and 42 respectively. Tubes 38, 40 and 42 each have a threaded hole through the circumference of each tube and a bolt 44 which screws into the hole, see FIG. 2. When the horizontal wire units 32 are in place such that the vertical wires are through tubes 38, 40 and 42, tightening of bolt 44 into the hole within a tube secures the position of a horizontal unit along the length of the vertical wires.

Hooks 46 may be optionally present extending from the rear of rack 10 attaching either to a vertical wire or to a horizontal wire enabling the wire display rack to be supported by a rear support structure such as a peg board by placing the hooks into the holes present in the peg board.

Figure 3:
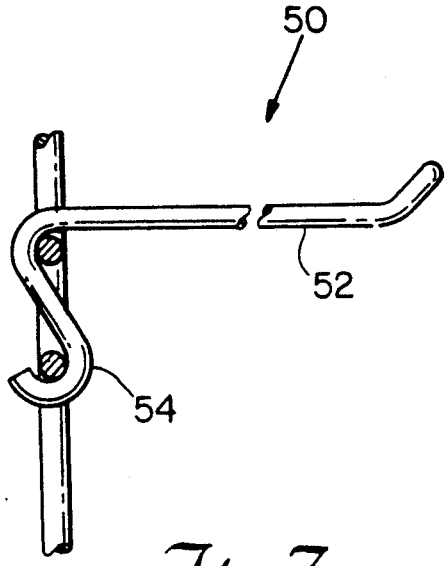
FIG. 3 is a cross-sectional view of a preferred embodiment of a bracket of the present invention.

As is shown in FIGS. 1 and 3, wire rack 10 also contains a plurality of wire brackets 50. Brackets 50 are comprised of a support element 52 and an intertwining connecting element 54 which extends from element 52 goes over and under upper horizontal wire 36 and proceeds over and under lower wire 34 in an inverted 'S' shape thus creating a positive locking bracket which will not detach if force is applied to the top or the bottom of the bracket. Bracket 50 can be readily moved laterally along horizontal wire unit 32. Thus, a wire display rack is formed which is adjustable both horizontally and vertically.

Figure 4:
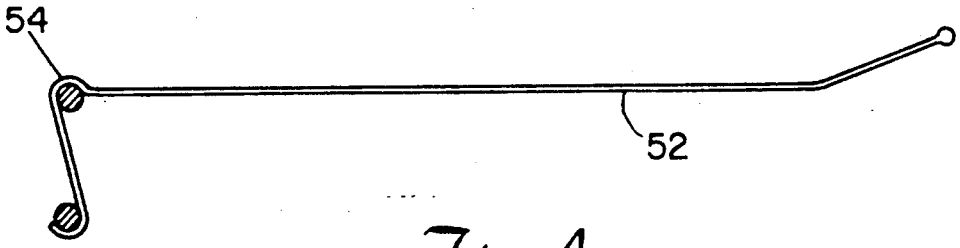
FIG. 4 is a cross-sectional view of a preferred embodiment of a bracket of the present invention.

FIG. 4 shows a preferred embodiment of a bracket of the present invention. In this embodiment connecting element 54 curves down before it connects with support element 52 to totally surround upper portion of horizontal wire 36 to give added strength to the positive locking mechanism.

Figure 5:
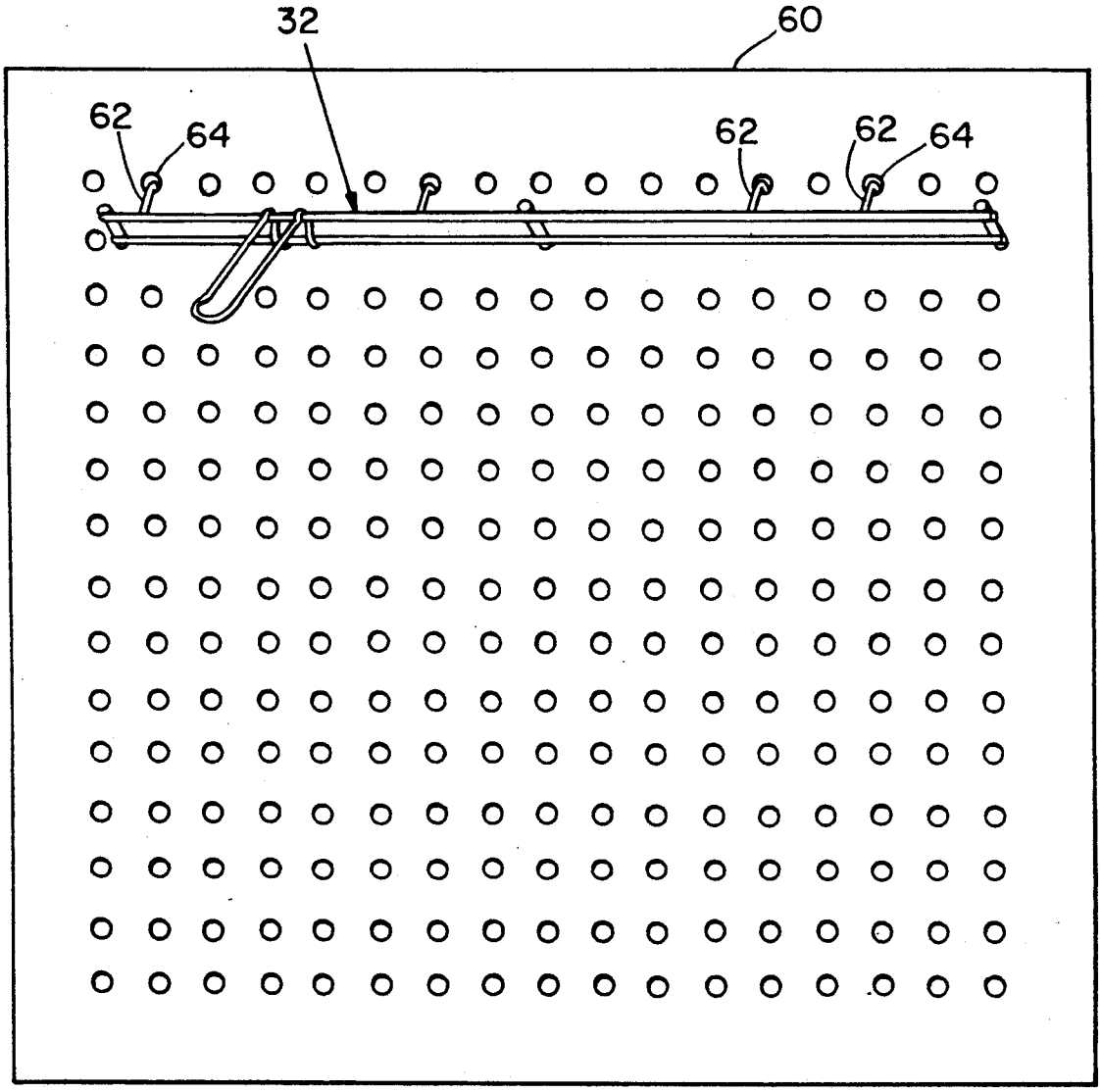
FIG. 5 depicts the horizontal wire support structure of the present invention supported by a peg board.

FIG. 5 depicts horizontal wire unit 32 connected to a peg board 60. Hooks 62 extend from horizontal wire unit 32 and are placed into holes 64 of peg board 60.

While only a few embodiments of the present invention have been shown and described, it is obvious that many changes and modifications may be made thereunto without departing from the spirit and scope of the invention.

INDUSTRIAL APPLICABILITY

The present invention can be used to display merchandise in such places as store windows and merchandise racks.

I claim:

1. A wire display rack comprising:

vertical support wires; and a plurality of horizontal wire support units, said horizontal wire support units being comprised of two horizontal wires, said horizontal wires being attached to a plurality of tubes such that the vertical support wires can each be simultaneously placed through a single tube attached to two horizontal wires, the tubes having means for locking a horizontal wire unit into position along the length of the vertical wires.

2. A wire display rack as recited in claim 1, wherein the means for locking a horizontal unit into position along the length of the vertical wires is a bolt which screws into a threaded hole present in the tube attached to the horizontal wire.

3. A wire display rack comprising:

vertical support wires;

horizontal wires;

means for attaching the horizontal wires to the vertical support wires such that the horizontal wires are adjustable up and down the length of the vertical wires and brackets extending from the horizontal wires, said brackets having a support member for holding merchandise and an attaching member, said attaching member extending from the support member and connecting to one or more horizontal wires.

4. A wire display rack comprising:

a board containing a plurality of holes;

horizontal wires;

means extending from the horizontal wires for attaching the horizontal wires to the board by means of the holes such that the horizontal wires are adjustable up and down the length of the board; and brackets extending from the horizontal wires, said brackets having a support member for holding merchandise and an attaching member, said attaching member extending from the support member and connecting to one or more horizontal wires.

5. A wire display rack as recited in claim 3, wherein the means for attaching the horizontal wires to the vertical wires are tubes attached to the horizontal wires such that each vertical wire can be simultaneously placed through a separate tube resulting in the horizontal wires being attached to the vertical wires and being movable up and down the length of the vertical wires.

6. A wire display rack as recited in claim 5, wherein the means for locking the horizontal wires into position is a bolt which screws into a threaded hole present within the circumference of the tube.

7. A wire display rack as recited in claim 5, wherein two horizontal wires are attached to a tube producing a horizontal wire unit.

8. A wire display rack as recited in claim 3, wherein the attaching member of the brackets extends from the support member of the brackets over and under an upper horizontal wire and over and under a lower horizontal wire.

9. A wire display rack as recited in claim 8, wherein the brackets can be moved laterally along the horizontal wires.

10. A wire display rack as recited in claim 3, wherein the attaching member of the brackets is a wire extending from the support member of the bracket over and under and under an upper horizontal wire and over and under a lower horizontal wire.

11. A wire display rack as recited in claim 3, wherein the bracket attaches onto the horizontal wires by means of a positive lock mechanism.

* * * * *